US005893489A

United States Patent [19]

Giarrante

[11] Patent Number: 5,893,489

[45] Date of Patent: Apr. 13, 1999

[54] CONTAINER-LID INCLUDING POURING SPOUT AND BRUSH-SUPPORT

[76] Inventor: Gary C. Giarrante, 300 Amendodge Dr., Shorewood, Ill. 60431

[21] Appl. No.: 08/688,106

[22] Filed: Jul. 29, 1996

[51] Int. Cl.[6] ..... B67D 3/00

[52] U.S. Cl. ..... 222/482; 222/545; 222/556; 222/570; 220/254; 220/695; 220/697; 220/701

[58] Field of Search ..... 220/695, 696, 220/697, 698, 699, 700, 701, 702, 254, 259; 222/192, 545, 548, 556, 570, 482, 569, 567

[56] References Cited

U.S. PATENT DOCUMENTS

| | | | |
|---|---|---|---|
| D. 325,170 | 4/1992 | Frantz . | |
| 1,791,004 | 2/1931 | Shepard | 222/482 |
| 2,418,502 | 4/1947 | Ferguson | 220/697 X |
| 3,298,561 | 1/1967 | McConnie | 220/695 |
| 3,309,000 | 3/1967 | Haverstick | 220/698 X |
| 3,972,453 | 8/1976 | Kapples | 222/570 X |
| 3,980,213 | 9/1976 | Ramsay | 222/570 X |
| 4,009,802 | 3/1977 | Hayduchok | 220/701 X |
| 4,034,901 | 7/1977 | Kirk | 222/570 X |
| 4,518,094 | 5/1985 | Kodman | 220/254 |

*Primary Examiner*—Kenneth Bomberg

*Attorney, Agent, or Firm*—Breiner & Breiner; Francis J. Bouda

[57] ABSTRACT

The cover of the present invention includes a base member and a lid which can be fastened to a container such as a paint can to provide an air-tight and fluid-tight arrangement. The base snaps on to a top of a container and includes a central portion, one-half of which is open and the other half of which is closed to provide a shelf. A lid is pivotally attached to the base and includes a spout which is disposed above the opening in the base when the base and the lid are interconnected but arranged so that the lid can be pivoted away from and above the base. The lid also includes a vent which permits the contents of the container to be poured through the opening in the base and the spout in the lid when the lid and the base are tightly interconnected.

4 Claims, 1 Drawing Sheet

VENT
CLOSED
OPEN

CONTAINER-LID INCLUDING POURING SPOUT AND BRUSH-SUPPORT

FIELD OF THE INVENTION

This invention relates to a cover for a container, particularly a large container such as a one gallon pail, and even more specifically to a container for paints or similar materials which can be applied with a brush.

Devices of this nature, without the unique features of the present invention, can be found in U.S. classes 222/530; 222/570; D9/447 and related art.

More specifically, similar devices have been disclosed in U.S. Pat. No. 3,972,453 and Design Pat. No. 325,170.

BACKGROUND OF THE INVENTION

Replaceable covers for enclosing large containers such as one gallon and five gallon containers are not new, and it is also not novel to have covers which securely close the container in a manner which prevents the spilling of the liquid contained therein, and also provides an air-tight storing device so that the contents will not harden or evaporate.

Many such devices have been provided for paint cans, putty containers and other evaporatable liquid, but the cover of the present invention provides, in a unitary arrangement, a device which permits easy pouring, air-tight storing, easy opening for dipping of a paint brush into the container, and, furthermore, a built-in brush rest to provide a resting place for a paint brush during use, which permits the paint on the brush to drip back into the container.

This container includes a gasket-type sealing-lip which permits it to be applied to a wide variety of containers used in the paint-applying industry.

SUMMARY OF THE INVENTION

The cover of the present invention includes a base member constructed and arranged to snap securely and tightly over the rim or chine of a container. The base member includes an opening and a shelf.

Pivotally attached to the base member, at one side via a hinge, and the other side via a finger-lifting device, is a flip-top lid which is constructed and arranged to engage the base member and close the container when the lid is closed upon the base.

When the lid is elevated above the base, the shelf part of the base provides a resting portion upon which a paint brush can be placed to permit the wet paint on the brush to drip back into the container through the opening in the base.

The lid includes a pouring spout which, when the base member and the lid are interconnected, is in alignment with the opening in the base member, and thus the contents of the container can be poured out through the spout.

The lid includes a cap which can be tightly affixed to the spout to prevent evaporation of the contents and which, when removed, permits the contents to be poured out through the spout.

The lid also includes a vent-arrangement which, when moved to an open position, permits air to enter the container when the contents thereof are poured out through the pouring spout.

The general object of the present invention is to provide a unitary cover, including a base, a lid, a cap and a vent, which can be applied to any standard paint or similar contents container.

A further object of the present invention is to provide a closure for a paint can which includes an air tight storage arrangement, an easy pouring arrangement, and a paint brush supporting arrangement.

Another object of the present invention is to provide a closure for paint cans which can be relatively inexpensively manufactured and assembled, and provides a multiplicity of advantages not found in closures of the prior art.

With the above and other objects in view, further information and a better understanding of the present invention may be achieved by referring to the following detailed description:

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

BRIEF DESCRIPTION OF THE DRAWINGS

In the drawings, wherein like reference characters indicate like parts.

DESCRIPTION OF THE PREFERRED EMBODIMENT

Figures 1, 2, 3, 4, 5, 6, 7, 8, 9, 10:
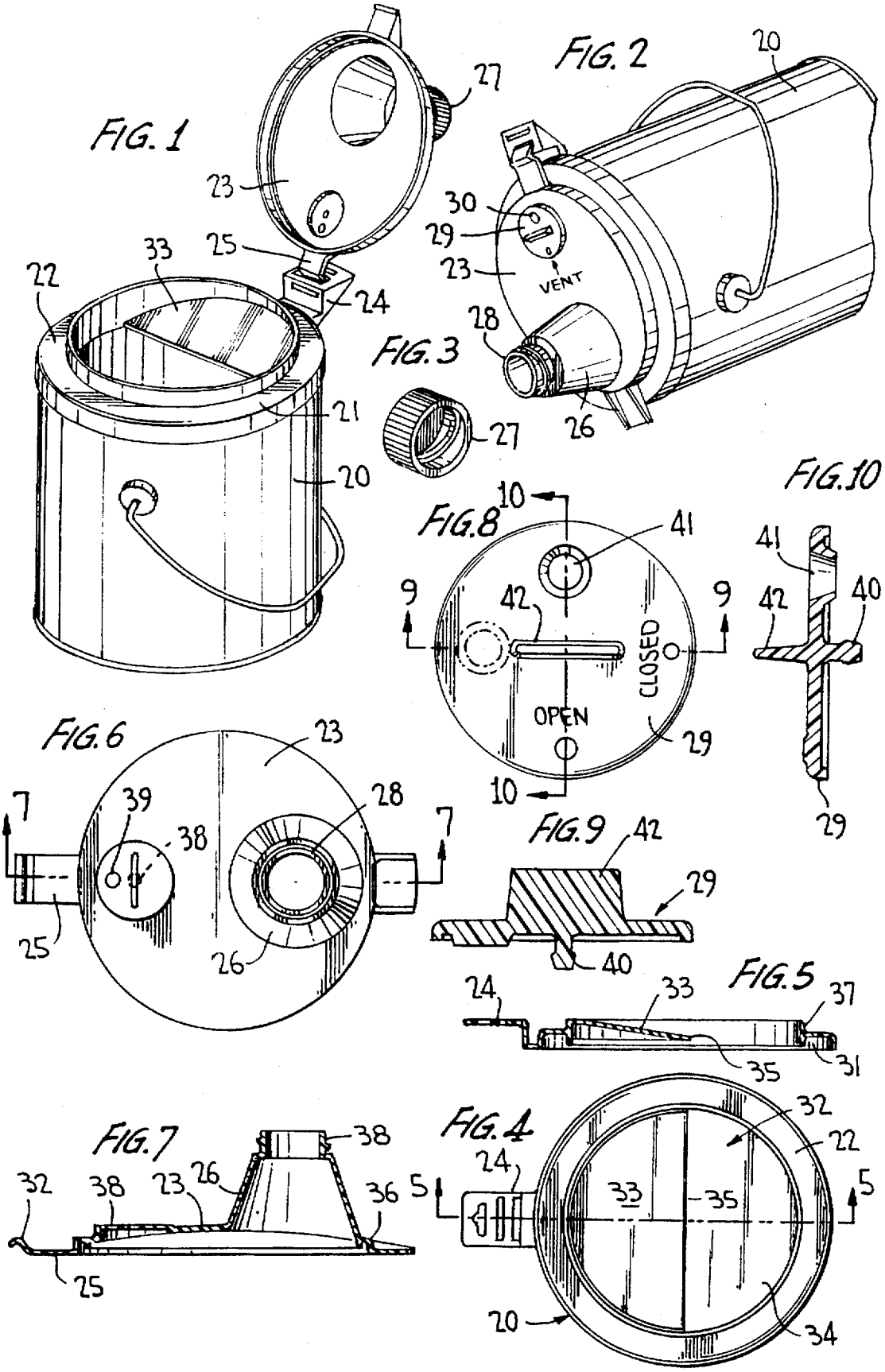
FIG. 1 is a perspective view of a fluid container with a cover of the present invention applied to the top thereof and with the cover elevated above the container.
FIG. 2 is a perspective view showing how the contents of a container can be poured through the spout in the lid when the lid and base are closed against the top of the container.
FIG. 3 is a perspective view of the cap which closes the spout on the lid of the present invention.
FIG. 4 is a top plan view of the base member.
FIG. 5 is a vertical cross-sectional view taken generally along lines 5—5 of FIG. 4.
FIG. 6 is a top plan view of the lid of the cover of the present invention.
FIG. 7 is a vertical cross-sectional view taken generally along line 7—7 of FIG. 6.
FIG. 8 is a top plan view of the venting device.
FIG. 9 is a vertical cross-sectional view taken generally along line 9—9 of FIG. 8.
FIG. 10 is another vertical cross-sectional view taken generally along line 10—10 of FIG. 8.

Referring now to the drawings and particularly to FIG. 1, there is shown a fluid container 20, such as a paint can or similar device, on which the cover 21 of the present invention is fastened at the top or open end of the container 20. The cover 21 includes a base member 22 and a lid 23. The base member 22 is fastened to the open end of the container 20, as it will be hereinafter described, and includes a hinge portion 24 which interlocks with a hinge portion 25 of the lid 23.

The cover 23 also includes a spout 26 which can be closed by the cap 27 when the internal thread on the cap engages the external threads 28 at the end of the spout.

The lid 23 also includes a venting device 29 which, when turned the position shown in FIG. 2, permits air to enter through the hole or port 30 and thus permits the contents of the container 20 to flow easily out through the spout 26.

Referring now to FIG. 4 and FIG. 5, the base member 22 includes a channel-rim 31 which snaps tightly over the rib or top edge or chine of the can 20.

The hinge member 24 extends at one side of the base 22 where it can receive and be interlocked with a mating member of the hinge portion 25 on the lid 23.

An opening 32 in the base 22 includes a shelf 33 which closes approximately one-half of the opening 32, leaving an open area 34 through which a paint brush may be inserted. The edge 35 of the shelf 33 approximately bisects the central opening 32 and thus effectively closes off one-half of the upper opening of the container 20 and affords a shelf on which a paint brush can be rested, and also affords the opening 34 through which the paint brush can be dipped into the container.

The lid 23 is shown more specifically in FIGS. 6 and 7, and as can be seen in FIGS. 1 and 2, the hinge portion 25 of the lid interlocks with the hinge portion 24 of the base 22.

The lid 23 also has a channel member or portion 36 which, when the lid 23 is lowered against the base 22, engages the rim 37 of the base 22, to provide a fluid-tight seal between the base and the cover.

The cover also includes two small openings 38 and 39. The opening 38 is designed to receive a pivot pin 40 on the vent 29 and the opening 39 is arranged so that a hole 41 in the vent 29, when the hole 39 and 41 are in alignment, permits air to enter the container, even though the cover is tightly closed against the base and the cap is tightly screwed on to the spout 26.

A finger grip 42 on the vent 29 permits the vent to be turned around the pin 40 to bring the holes 41 and 39 into alignment or to close off the hole 39 when the vent is turned so that the holes 41 and 39 are not in alignment.

In this latter position, the container is maintained in a fluid-tight and air-tight condition, with the base tightly fitted onto the container and the chine tightly fastened to the base, and with the cap tightly screwed onto the pouring spout and the vent turned so that the holes 39 and 41 are not in alignment.

It is further to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described my invention what is claimed as new and desired to protect by letters patent are the following:

1. A cover for a container, said cover including a base and a lid, said base including a channel for attachment to the container, said base including a hinge, said base including a central opening, one portion of which includes a shelf, said base including a rim, said lid including a hinge for engagement with the hinge of said base, said lid including a channel for engagement with said rim, said lid including a spout arranged on said lid so as to be in alignment with the opening on said base when said rim and channel are inter-engaged.

2. The cover of claim 1 wherein said lid has a vent hole and a rotatable vent operatively engaged with said lid so as to open and close said vent hole.

3. The cover of claim 1 wherein the spout of said base member includes a threaded portion adapted to receive a threaded cap member.

4. The cover of claim 1 wherein the shelf portion of the base member covers at least one-half of the central opening in said base member.

* * * * *